US011952789B1

(12) United States Patent
Bond

(10) Patent No.: US 11,952,789 B1
(45) Date of Patent: Apr. 9, 2024

(54) UNIVERSAL PROP SYSTEM FOR GRID SHORING

(71) Applicant: BOND FORMWORK SYSTEMS, LLC, Waller, TX (US)

(72) Inventor: Bradley D. A. Bond, Waller, TX (US)

(73) Assignee: Bond Formwork Systems, LLC, Houston, TX (US)

( * ) Notice: Subject to any disclaimer, the term of this patent is extended or adjusted under 35 U.S.C. 154(b) by 0 days.

(21) Appl. No.: 18/219,553

(22) Filed: Jul. 7, 2023

Related U.S. Application Data

(60) Provisional application No. 63/485,087, filed on Feb. 15, 2023.

(51) Int. Cl.

| | |
|---|---|
| ***E04G 25/04*** | (2006.01) |
| ***E04G 11/48*** | (2006.01) |
| ***E04G 11/50*** | (2006.01) |
| ***E04G 25/06*** | (2006.01) |
| *E04G 25/00* | (2006.01) |

(52) U.S. Cl.
CPC ..... *E04G 25/06* (2013.01); *E04G 11/486* (2013.01); *E04G 11/50* (2013.01); *E04G 25/00* (2013.01); *E04G 25/04* (2013.01)

(58) Field of Classification Search
CPC ... E04G 25/00; E04G 25/04; E04G 2025/003; Y10T 292/67; E04B 1/3511; E04B 2/821
USPC ..... 248/351, 354.1, 354.3, 354.4, 354.6; 52/125.1, 126.1
See application file for complete search history.

(56) References Cited

U.S. PATENT DOCUMENTS

| | | | | |
|---|---|---|---|---|
| 4,870,789 | A * | 10/1989 | Clark | E02D 35/00 52/126.5 |
| 6,481,912 | B2 * | 11/2002 | Shih | E04G 25/061 403/49 |
| 7,255,312 | B2 * | 8/2007 | Melic | E04G 21/3233 248/200.1 |
| 10,024,069 | B2 * | 7/2018 | Bond | E04G 11/38 |
| 10,711,472 | B2 * | 7/2020 | Bond | E04G 11/38 |
| 2012/0042600 | A1 * | 2/2012 | Bacon | E04G 25/00 52/632 |

* cited by examiner

*Primary Examiner* — Alfred J Wujciak
(74) *Attorney, Agent, or Firm* — Mehrman Law Office; Michael J. Mehrman

(57) ABSTRACT

A universal prop system for grid shoring provides increased versatility and cost effectiveness over conventional grid shoring systems for building construction, such as concrete parking garage construction. The universal props include a variety of interchangeable prop stands, interchangeable drop heads, and interchangeable stringer jacks with a variety of different types of stringer heads. The interchangeable drop heads interconnects the interchangeable stringer jacks with the interchangeable prop stands. The interchangeable drop heads are designed to support a variety of different types of rails, such as beams, joists, rafters, pipes, etc. The interchangeable stringer jacks include a number of different stringer heads configured to support a variety of different stringers. The different stringer heads include, for example, U-heads, spindle forks and jack plates, with and without detachable threaded shafts.

6 Claims, 10 Drawing Sheets

UNIVERSAL PROP SYSTEM FOR GRID SHORING

REFERENCE TO RELATED APPLICATIONS

This application claims filing priority to commonly-owned U.S. Provisional Patent Application Ser. No. 63/485,087 filed Feb. 15, 2023, which is incorporated by reference.

TECHNICAL FIELD

This disclosure is related to grid shoring systems for building construction and, more particularly, to a universal prop system for assembling a variety of differently configured prop assemblies from a variety of interchangeable prop stands, interchangeable drop heads, and interchangeable stringer jacks with a variety of different stringer heads.

BACKGROUND

When constructing buildings, parking garages and other structures, grid shoring systems are often used to carry a load while structural concrete sets or permanent beams are fixed in position. The grid shoring systems may include platform supports that support multiple main beams on head assemblies that include seats. The main beams are typically installed by lowering each main beam onto the seats of adjacent head assemblies, and the main beams and seats may support a plurality of secondary beams extending between parallel main beams. One or more panels may rest on the main beams and secondary beams to form a platform that carries the load.

U.S. Pat. No. 10,024,069, which is incorporated by reference, describes a grid shoring system in which a platform support, also referred to as a "prop," is raised or lowered to position concrete forms and other structures at the correct height while the concrete is poured and allowed to set. The props often utilize drop head assemblies that ease the removal of the concrete forms and other structures supported by the prop after the concrete has set. A drop head assembly typically includes a drop seat that is held in position by a slot plate, which is retained in an upper position by a pin extending through the drop head assembly. When the slot plate is rotated to align the slot with the pin, both the slot plate and the seat pass over the pin, dropping the seat to a lower position. This drops the concrete forms and other structures supported by the prop head seat allowing for easy removal of the concrete forms and other structures. This patent described props with upper drop heads and lower seats with fixed seat plates. While reducing the total number of props required to support the concrete forms by the system, the lower seats are fixed in position on the drop head assembly, which only facilitates removal of the concrete forms supported by the upper drop heads. In addition, in this grid shoring system, the seat plates on the drop head and lower seats have fittings specifically configured to removably interlock with corresponding fittings on standard manufactured beams, which restricts the types of beams that can be supported by the props to these specific manufactured beams.

U.S. Pat. No. 10,711,472, which is also incorporated by reference, describes a grid shoring system in which the props include both upper and lower drop heads allowing the props to position two platforms at different heights with support structures at different levels, while allowing the upper and lower drop seats to be lowered to facilitate removal of the concrete forms. Prior drop heads were not configured for this adaptation because a pin extending through the drop head prevented a prop shaft from extending through the lower drop head, which prevented the use of a telescoping-type assembly to adjust the height of the lower platform support. In other words, in the prior dual-seat props described in U.S. Pat. No. 10,024,069, the lower seat plate was fixed in position. Instead of the conventional pin passing through the drop head, the improved drop head utilizes a strut and rotating slot collar on the outside of an unobstructed bore to releasable support a drop seat allowing a telescoping prop shaft to extend through the drop head. Again, in this improved grid shoring system, the seat plates on both drop heads have fittings specifically configured to removably interlock with corresponding fittings on standard manufactured beams, which restricts the types of beams that can be supported by the props to these specific manufactured beams. There remains a need for improved, more versatile, and more cost effective grid shoring systems.

SUMMARY

The presently claimed subject matter may be embodied in a universal prop assembly for a grid shoring system for building construction that includes an interchangeable prop stand, an interchangeable drop head, and an interchangeable stringer jack. The interchangeable drop head removably interconnects the interchangeable prop stand with the interchangeable stringer jack and includes a drop seat defining a bottom rail interface to removably support a bottom rail of the grid shoring system. The drop seat is selectively movable between an upper drop seat position and a lower drop seat position to move the bottom rail between an upper bottom rail position and a lower bottom rail position top rail position. The stringer jack includes a threaded rod, a threaded collar movably captured on the threaded rod, and a stringer head connected to the threaded rod to support a top rail of the grid shoring system. The stringer jack telescopically interconnects with the drop head to selectively move the stringer head with respect to the drop head between an upper stringer head position and a lower stringer head position in response to rotation of the threaded collar to move the top rail between an upper top rail upper position and a lower top rail position.

It will be understood that specific embodiments may include a variety of features and options in different combinations, as may be desired by different users. Practicing the invention does not require utilization of all, or any particular combination, of these specific features or options. The specific techniques and structures for implementing particular embodiments of the invention and accomplishing the associated advantages will become apparent from the following detailed description of the embodiments and the appended drawings and claims.

The above presents a simplified summary in order to provide a basic understanding of some aspects of the invention. This summary is not an exhaustive overview of the invention. It is not intended to identify key or critical elements of the disclosure or to delineate the scope of the invention. Its sole purpose is to present some concepts in a simplified form as a prelude to the following more detailed description, appended drawings, and claims.

BRIEF DESCRIPTION OF THE DRAWINGS

Illustrative embodiments of the subject matter claimed below will now be disclosed. In the interest of clarity, not all features of an actual implementation are described in this specification. It will be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort, even if complex and time-consuming, would be a routine undertaking for those of ordinary skill in the art having the benefit of this disclosure.

DESCRIPTION OF ILLUSTRATIVE EMBODIMENTS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion. In the interest of clarity, not all features of an actual implementation are described for every example in this specification. It will be appreciated that in the development of any such actual implementation, numerous implementation-specific decisions may be made to achieve the developers' specific goals, such as compliance with system-related and business-related constraints, which will vary from one implementation to another. Moreover, it will be appreciated that such a development effort, even if complex and time-consuming, would be a routine undertaking for those of ordinary skill in the art having the benefit of this disclosure.

Embodiments of the presently claimed subject matter universal props, a universal prop system, and grid shoring systems using the universal prop system for building construction, such as concrete parking garage construction. The universal props include a variety of interchangeable prop stands, interchangeable drop heads, and interchangeable stringer jacks with a variety of different types of stringer heads. The interchangeable drop heads interconnects the interchangeable stringer jacks with the interchangeable prop stands.

The interchangeable drop heads are designed to support a variety of different types of rails, such as beams, joists, rafters, pipes, etc. The interchangeable stringer jacks include a number of different stringer heads configured to support a variety of different stringers. The different stringer heads include, for example, U-heads, spindle forks and jack plates, with and without detachable threaded shafts. The improved universal prop system results in increased versatility and cost effectiveness over conventional grid shoring systems, such as those described in U.S. Pat. Nos. 10,024,069 and 10,711,472.

Figure 1A:
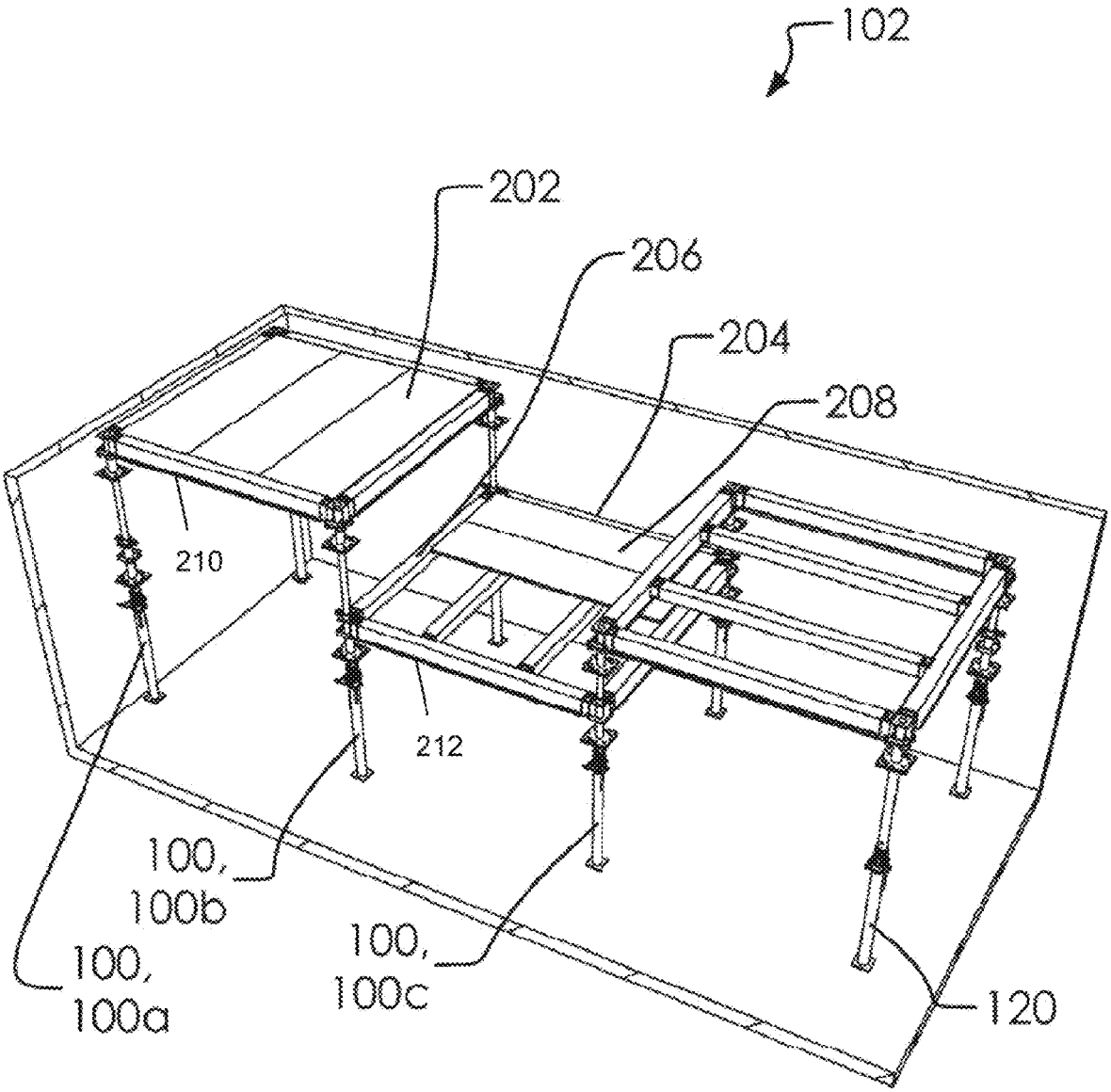
FIG. 1A (PRIOR ART)
FIG. 1A (prior art) is reproduction of FIG. 2 of U.S. Pat. No. 10,024,069 illustrating a conventional grid shoring system.
Figure 2:
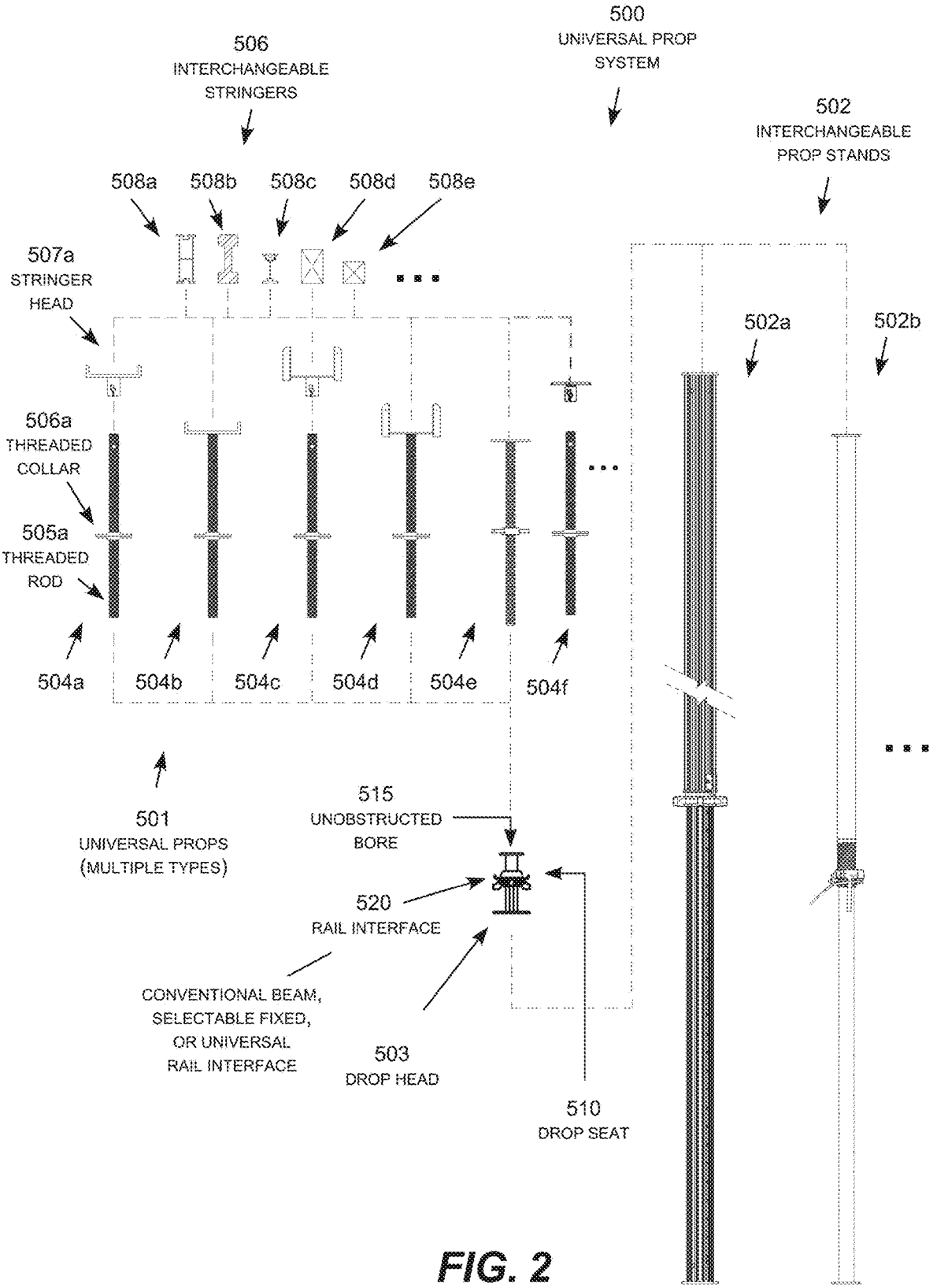
FIG. 2 is a conceptual illustration of a universal prop system for a grid shoring system.

FIG. 1A (prior art) is reproduction of FIG. 2 of U.S. Pat. No. 10,024,069 (the "069 patent") illustrating a conventional grid shoring system 102. The prop assemblies 100-100*a*, 100-100*b* and 100-100*c* support an upper platform 202 and a lower platform 208 an adjustable separation distance from the upper platform. More specifically, the prop assemblies support upper beams represented by the enumerated upper beam 210 (element numeral added) that support the upper platform 202. Similarly, the prop assemblies also support lower beams represented by the enumerated lower beam 212 (element numeral added) that support the lower platform 202. The prop assemblies allow vertical adjustment of the lower beam 202 with respect to the upper beam 210 for positioning the lower platform 208 an adjustable separation distance from the upper platform 202.

Figure 1B:
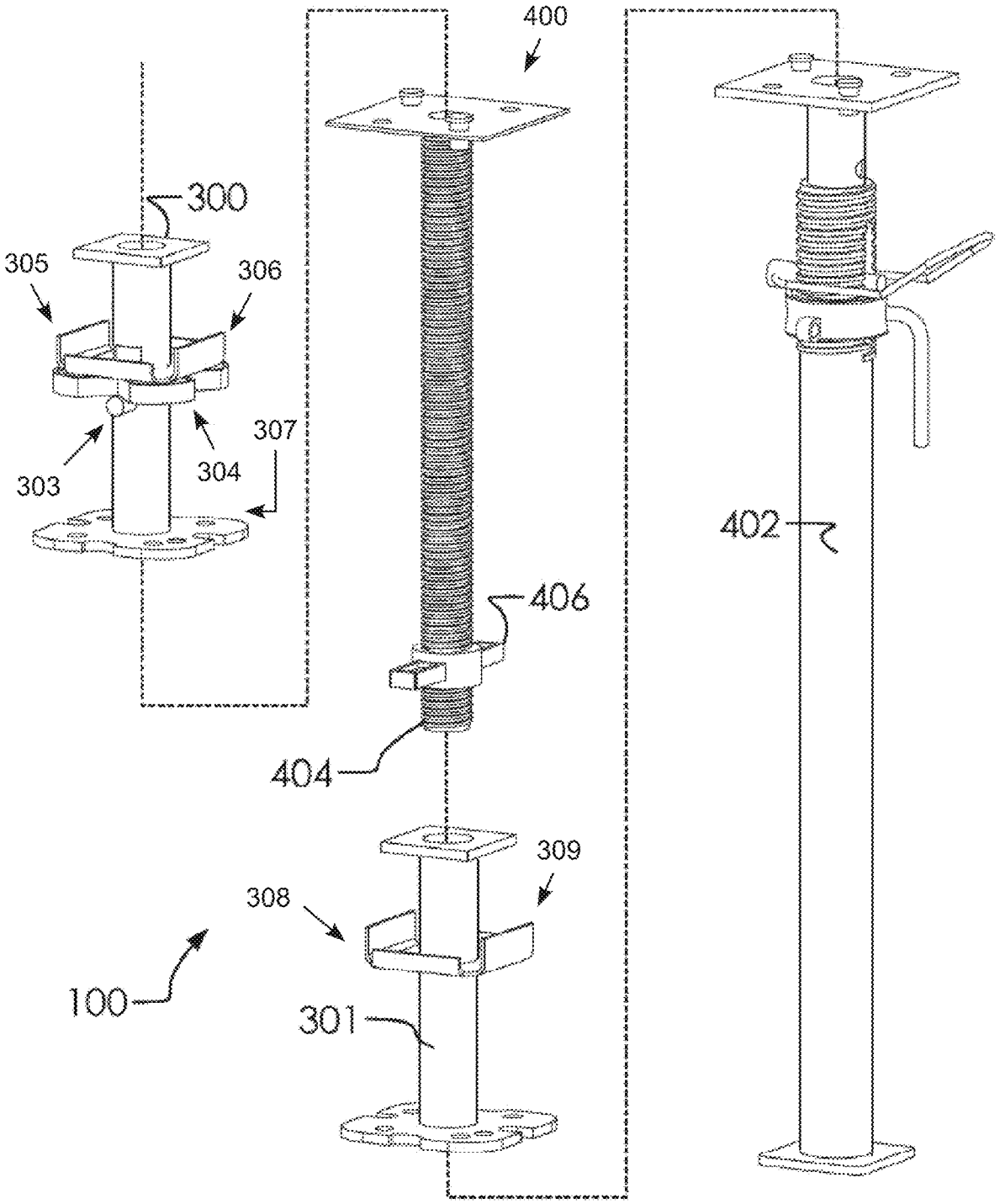
FIG. 1B (PRIOR ART)
FIG. 1B (prior art) is reproduction of FIG. 12 of U.S. Pat. No. 10,024,069 illustrating a conventional prop assembly for the conventional grid shoring system.

FIG. 1B (prior art) is a reproduction of FIG. 12 of the 069 patent illustrating the conventional prop assembly 100, which includes a drop head 300 that sits on top of a screw jack 400 (element numeral added) with a threaded rod 404 and a threaded collar 406. Rotation of the threaded collar 406 adjusts the position of the threaded collar along the threaded rod 404 allowing height adjustment of the screw jack 400. Referring also to FIG. 1A, the drop head 300 includes a pin 303 (element numeral added) and slot plate 304 (element numeral added) that allows a drop seat plate 305 (element numeral added) to be retained in an upper position while the upper platform 202 sets.

The upper beam 210 is a standard manufactured beam with interface fittings configured to removably interlock with corresponding fittings represented by the enumerated fitting 306 (element numeral added) on the drop seat plate 305. Once the concrete of the upper platform 202 has sufficiently set, the slot plate 304 is rotated to align the slot with the pin 303 allowing the drop seat plate 305 to drop to the lower position 307 (element numeral added) to facilitate removable of the top rail 210 supporting the upper concrete platform 202.

The bottom of the threaded rod 404 is received within a seat 301, which sits on top a prop 402. Adjustment of the position of the collar 406 on the threaded rod 404 allows the screw jack 400 to be telescopically received within the seat 301. The collar 406 may be adjusted so that the threaded rod 404 extends through an unobstructed bore through the center of the seat 301. Referring also to FIG. 1A, the seat 301 includes a fixed seat plate 308 (element numeral added) that supports the bottom rail 212 an adjustable distance from the top rail 210, which allows the lower platform 204 to be constructed an adjustable separation distance from the upper platform 202.

Like the top rail 210, the bottom rail 212 is a standard manufactured beam with interface fittings configured to removably interlock with corresponding fittings represented by the fitting 309 (element numeral added) on the fixed seat plate 308. Unlike the drop head 300, however, the seat 301 does not include a feature that would allow the fixed seat plate 308 to drop to facilitate removal of the bottom rail 212 and associated concrete forms because the pin would obstruct the bore through the seat 301 preventing the threaded rod 404 from extending telescopically through the seat.

Figure 1C:
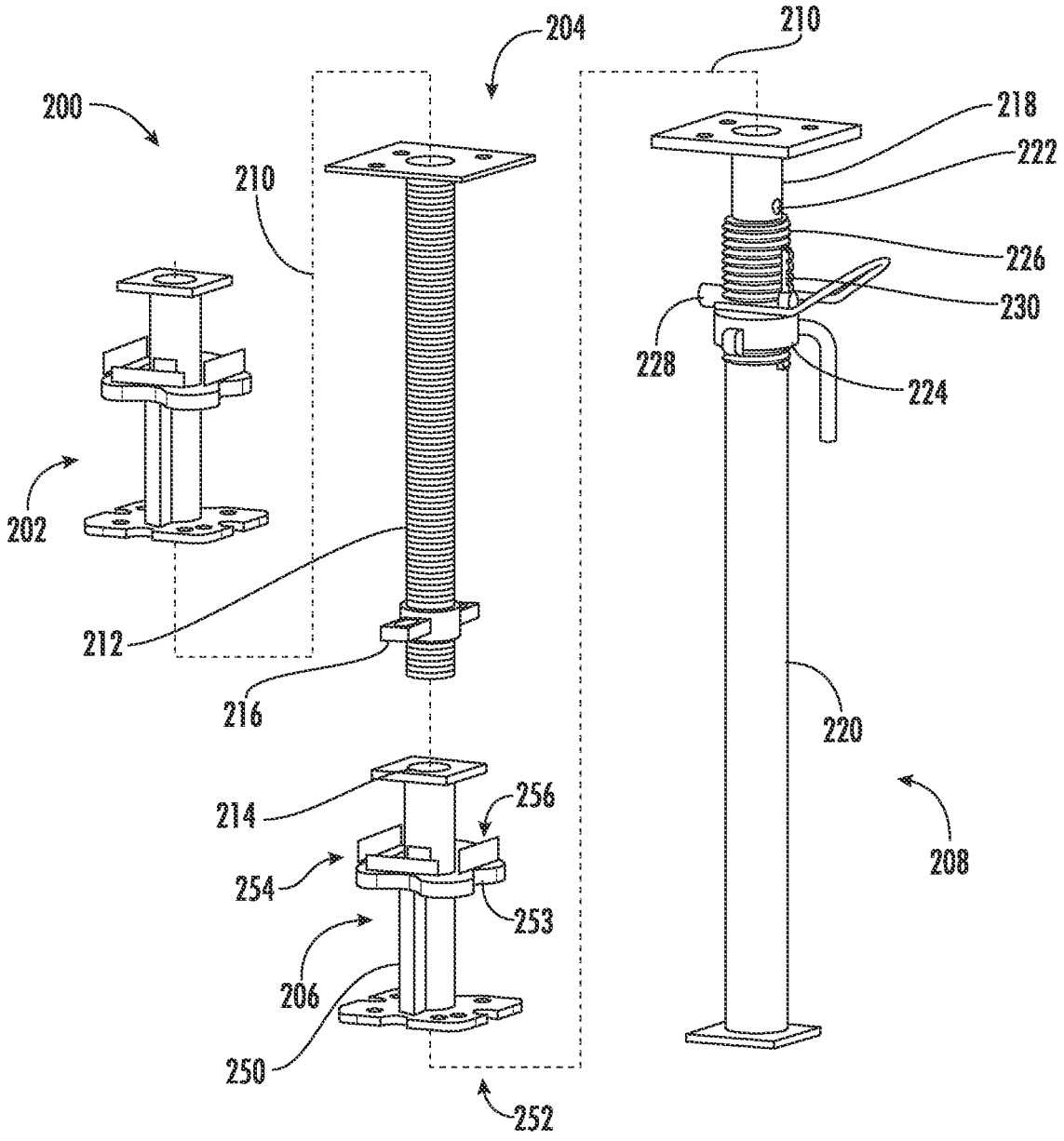
FIG. 1C PRIOR ART
FIG. 1C (prior art) is reproduction of FIG. 2 of U.S. Pat. No. 10,711,472 illustrating another conventional prop assembly.

FIG. 1 of U.S. Pat. No. 10,711,472 (the "472 patent") is substantially the same as FIG. 1A, while FIG. 1C (prior art) is a reproduction of FIG. 2 of the 472 patent. In this improved prop assembly 200, the seat 301 of the prop assembly 100 shown in FIG. 1A has been replaced by an improved drop head 206 in which the pin 303 has been replaced by a strut 250 (element numeral added) located on the outside of an unobstructed bore 252 (element numeral added) through the drop seat. A rotatable slot plate 253 (element numeral added) that selectively allows to the strut 250 to pass through allows the drop seat plate 254 to be selectively retained in an upper position or dropped to a lower position without interfering with the telescoping range of the threaded rod 212 of the screw jack 204 within the drop seat 206. Again, in this embodiment, the drop seat plate 254 of the improved drop head 206 is specifically designed with interface fittings represented by the enumerated fitting 256 (element numeral added) configured to removably interlock with corresponding fittings on standard beams. In this embodiment, the upper beam is likewise supported by a similar improved drop head 202.

The designs of the conventional prop assemblies 100 and 200 shown in FIGS. 1B and 1C suffer from a drawback in that the drop heads 202, 206 and 300 are limited to interfacing with standard manufactured beams with standard fittings designed to interlock with the corresponding fittings on the drop heads. Embodiments of the presently claimed subject matter provide improved universal props, a universal prop system, and associated grid shoring systems utilizing a variety of interchangeable prop stands, interchangeable drop heads, and interchangeable stringer jacks with a variety of different stringer heads. For example, the prop assemblies 100 and 200 in the conventional designs shown in FIGS. 1B and 1C may be replaced with universal prop assemblies including a variety different types of prop interchangeable stands, interchangeable drop heads, and interchangeable stringer jacks with a variety of different stringer heads, such as U-plates, spindle forks and jack plates. This increases the versatility and cost effectiveness of the prop system by allowing the same universal prop system to be used to assemble a variety of different universal prop assemblies incorporating a variety of different prop stands, a variety of different drop heads designed to support a variety of different bottom rails, and a variety of different stringer heads designed to support a variety of different stringers.

FIG. 2 is a conceptual illustration of the universal prop system 500 for a grid shoring system, which includes a number of interchangeable prop stands represented by the prop stands 502*a* and 502*b*. Other types of prop stands may be utilized depending on the height and weight of the loads to be supported. An interchangeable drop head 503 is removably attached to the top of interchangeable prop stand with fasteners, such as threaded joints, bolts, pins held in place by retainer clips, rivets with eccentric sockets, pivoting quick-release arms, sliding connectors, clips, cable ties, and the like. The drop head 503 includes a drop seat 510. which removably supports a bottom rail of the grid shoring system.

The drop head 503 is configured to interface with a variety of interchangeable stringers jacks represented by the enumerated stringer jacks 504*a*-504*f*. Referring to enumerated stringer jack 504*a* as representative, this stringer jack includes a threaded rod 505*a* carrying a threaded collar 506*a* and a detachable stringer head 507*a* that removably attaches to the top of the threaded rod 505*a*. The threaded rod 505*a* is telescopically received with an unobstructed bore 515 through the drop head 503.

Rotating the threaded collar 506*a* moves the collar along the threaded rod 505*a* to change the height of the stringer head 507*a* with respect to the drop head 503. This particular stringer jack 504*a* includes a detachable U-plate stringer head 507*a*, while the stringer jack 504*b* includes an attached U-plate stringer head, the stringer jack 504*c* includes a detachable spindle fork stringer head, the stringer jack 504*d* includes an attached spindle fork stringer head, the stringer jack 504*e* includes an attached jack plate stringer head, and the stringer jack 504*f* includes a detachable jack plate stringer head. The various stringer jacks 504*a*-504*f* are designed to interface with a variety of different types of stringers represented by the stringers 5008*a*-508*e*. Embodiments of the subject matter claimed below are not limited to these specific examples as other types of stringer jacks with other types of stringer heads supporting other types of stringers may be utilized as a matter of design choice, such as stringer heads designed to support pipes, posts, angles, flanges, preconfigured fittings on a variety of structures, and other suitable interfaces of the grid shoring system.

The drop head 503 for removably attaches to the top of a selected one of the interchangeable prop stands 502*a*-502*b*. The drop head 503 includes a drop seat 510 that defines a rail interface 505 configured to removably support one or more bottom rails of the grid shoring system. The drop seat 510 can be selectively moved between an upper position (upper drop seat position) and a lower position (lower drop seat position), which moves the bottom rail of the grid shoring system between an upper position (upper bottom rail position) and a lower position (lower bottom rail position) to facilitate installing and removing concrete forms for constructing a concrete structure supported by the grid shoring system.

The universal prop system 500 can be used to assemble a wide range of different universal props 501. Each universal prop includes a selected interchangeable prop stand, a selected drop head, and a selected interchangeable stringer jack. In a representative example, the selected stringer jack 504*a* includes a threaded rod 505*a*, a threaded collar 506*a* rotatably captured to move along the threaded rod by rotating the threaded collar, and a selected stringer head 507*a* sitting on top of the threaded rod.

The selected stringer jack removably slides into the selected drop head 503 with the threaded rod 505*a* telescopically received through an unobstructed bore 515 of the drop head 503 until the threaded collar 506*a* bears against the top of the drop head. The threaded collar 506*a* is rotated, typically with a wrench, to adjust the height of the stringer head 507*a* above the drop head 503 to a desired height. The stringer head 507*a* removably supports a selected stringer 508*a* which, in turn, removably supports a top rail of the grid shoring system.

After a concrete structure supported by the grid shoring system has sufficiently set, the drop seat 510 of the drop head 503 is dropped, typically by rotating the slot plate 506*a* with a wrench, which drops the bottom rail from its upper position (upper bottom rail position) to its lower position (lower bottom rail position) to facilitate removal of the concrete forms. Similarly, the threaded collar 506*a* of the stringer jack 504*a* is rotated, typically with a wrench, to drop the stringer head 507*a* from an upper position (upper stringer head position) to a lower position (lower stringer head position), which drops the stringer 508*a* from an upper position (upper stringer position) to a lower position (lower stringer position), which in turn drops the top rail from its upper position (upper top rail position) to a lower position (lower top rail position) to further facilitate removal of the concrete forms. The universal prop can then be disassembled for subsequent use of the component parts to assemble other universal prop assemblies on an as-needed, where-needed basis.

Figure 3A:
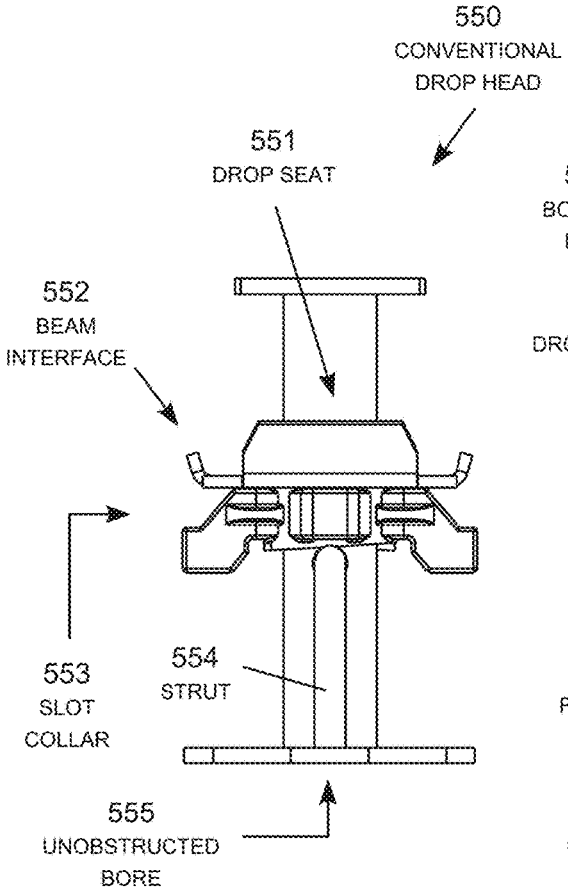
FIG. 3A (PRIOR ART)
FIG. 3A (prior art) is an elevational view of a conventional drop head.

FIG. 3A (prior art) is an elevational view of a conventional drop head 550 with a conventional drop seat 551, which includes standard beam interfaces configured to interconnect with corresponding fittings on manufactured beams represented by the enumerated standard beam interface 552. To allow the drop seat 510 to selectively move between an upper position (upper drop seat position) and a lower position (lower drop seat position), the drop head 550 includes a slot collar 553 that can be rotated without rotating the beam interface 552. This allows a slot on the slot collar 553 to be selectively aligned with the strut 554 on the outside of the unobstructed bore 555 to selectively move the conventional drop seat 551 from an upper position (upper drop seat position) to a lower position (lower drop seat position) to move the beam interface 552 from an upper position (upper beam position) to a lower position (lower beam position), without rotating the beam interface 552. The standard beam interfaces each define standard fittings designed to interface with corresponding fittings on standard manufactured beams. For example, the conventional beam interface 552 may be a standard beam interface with fittings specifically configured to removably interlock with corresponding fittings on standard manufactured beams described in U.S. Pat. Nos. 10,024,069 and 10,711,472.

Figure 3B:
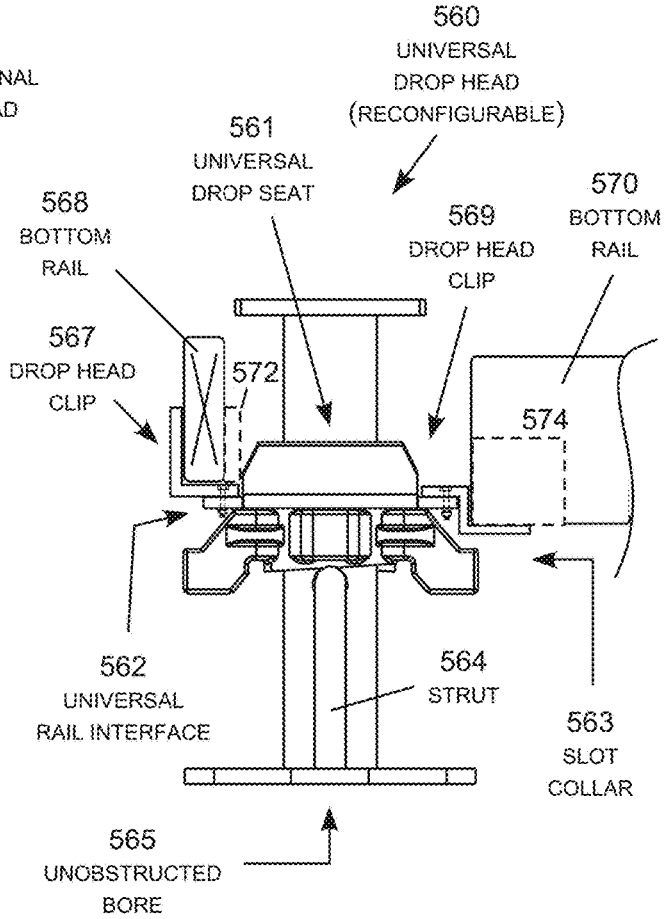
FIG. 3B is an elevational view of an alternative type of drop head with universal clip interfaces supporting first and second types of drop head clips.

FIG. 3B is an elevational view of an alternative type of universal drop head 560 with a universal drop seat 561, which includes a universal rail interface 562. The universal drop head 560 also includes a slot collar 563 that can be rotated without rotating the universal rail interface 562. This allows a slot on the slot collar 563 to be selectively aligned with the strut 564 on the outside of the unobstructed bore 565 to selectively retain the universal rail interface 562 in an upper position, or drop it to a lower position, without rotating the universal rail interface 562. In this embodiment, a first representative type of drop head clip 567 that can be removably bolted to the universal rail interface 562 is designed to support a first type of bottom rail 568. This example bottom rail 568 extends with its elongated dimension in a first direction (into the page). A second type of drop head clip 569 that can be removably bolted to the universal rail interface 562 is designed to support a second type of bottom rail 570 extending with its elongated dimension in a second direction (left to right). The drop head clips 567, 569 may include additional walls or other support structures as a matter of design choice to further support their corresponding rails in a desired position without the use of hands, a represented by the additional support walls 572 and 574 shown in dashed lines in FIG. 3B. The representative drop head clips 567 and 569 are removable allowing different types of drop head clips to be connected to the drop head 560 and an as-needed, where-needed basis.

Figure 4:
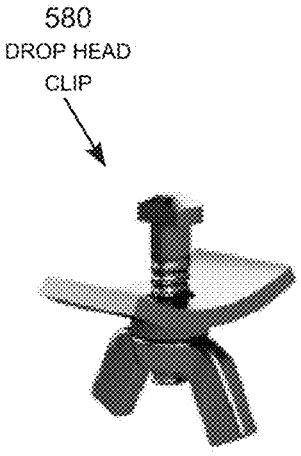
FIG. 4 is a perspective view of a third type of drop head clip.
Figure 5:
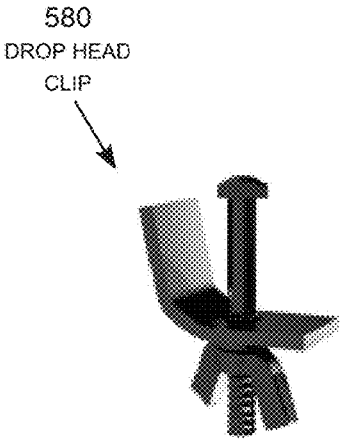
FIG. 5 is a perspective view of a fourth type of drop head clip.

To further illustrate the versatility of this system, FIG. 4 is a perspective view of a third type of drop head clip 580 shaped to support a round pipe, while FIG. 5 is a perspective view of a fourth type of drop head clip 582 shaped to support an angle flange. Various types of drop head clips may be specifically designed to conform to the contours of different types of bottom rails made of different materials, with different shapes, extending in different directions. The term "rail" in this context refers generally to any type of beam, board, pipe, post, angle, flange, manufactured beam, extruded metal beam, folded sheet metal beam, and so forth, fabricated from any suitable construction material, such as steel, wood, plastic, composite, etc. It will therefore be understood that term "rail" covers support members that may commonly be referred to by other names, such as beams, stringers, joists, rafters, pipes, posts, and the like.

In alternative embodiments, the drop head 503 of different universal props may include drop seats 510 different types of fittings, such as conventional beam fittings, selectable fixed fittings, or universal interfaces. Referring also to FIG. 2, in one embodiment, the upper portion of different universal props 501 can be different types stringer jacks 504*a*-504*f* with different types of stringer heads 508*a*-508*f*, while the drop head 503 positioned between the interchangeable prop stands 502*a*-502*b* and the selectable stringer jacks 504*a*-504*f* include conventional drop heads 550, as shown in FIG. 3A and 202, 206 on FIG. 2, with standard fittings designed to interconnect with corresponding fittings on standard manufactured beams. In alternative embodiments, different universal props may include selectable types of fixed-interface drop heads, where each type of fixed-interface drop head includes fittings designed to interface with a different type of beam, stringer or other rail. That is, each instance of an individual fixed drop head may have a permanent configuration, while different types of fixed drop heads may be selected with different fittings having different configurations designed to interface with different types of beam, stringers or other rails. In yet another embodiment described with reference to FIG. 3B, each instance of a universal drop head includes a reconfigurable drop seat configured to removably receive a different type of clip designed to interface with a different types of rail, such as beams, stringers, joists, rafters, pipes, posts, flanges, and so forth. In this embodiment, each instance of the drop head 50 is reconfigurable to interface with a different type of rail.

Figure 6A:
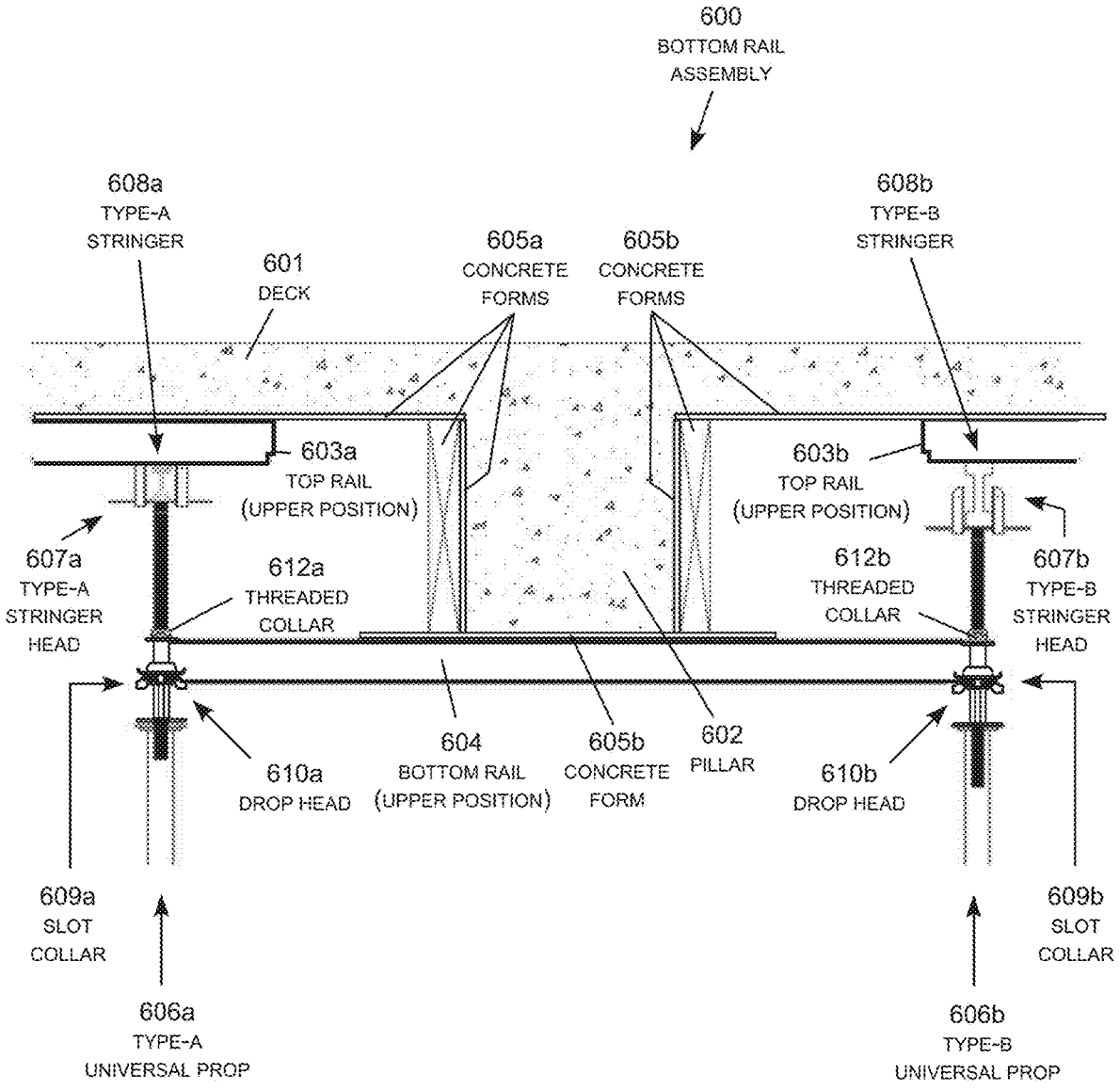
FIG. 6A is an elevational view of a bottom rail assembly with the top and bottom rails of the grid shoring system in upper positions.
Figure 6B:
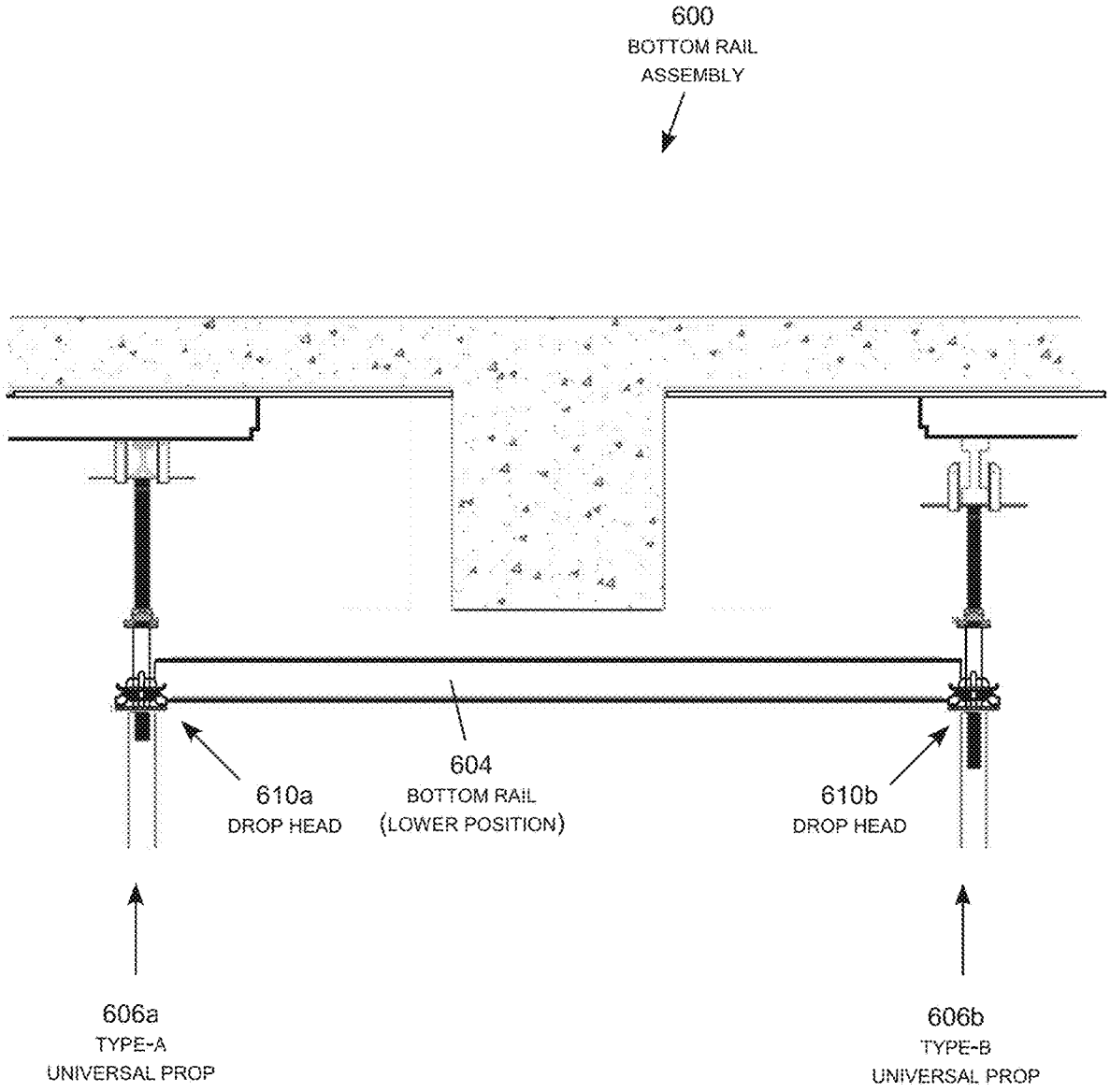
FIG. 6B is an elevational view of the bottom rail assembly with the top rails in their upper positions and the bottom rail in a lower position.
Figure 6C:
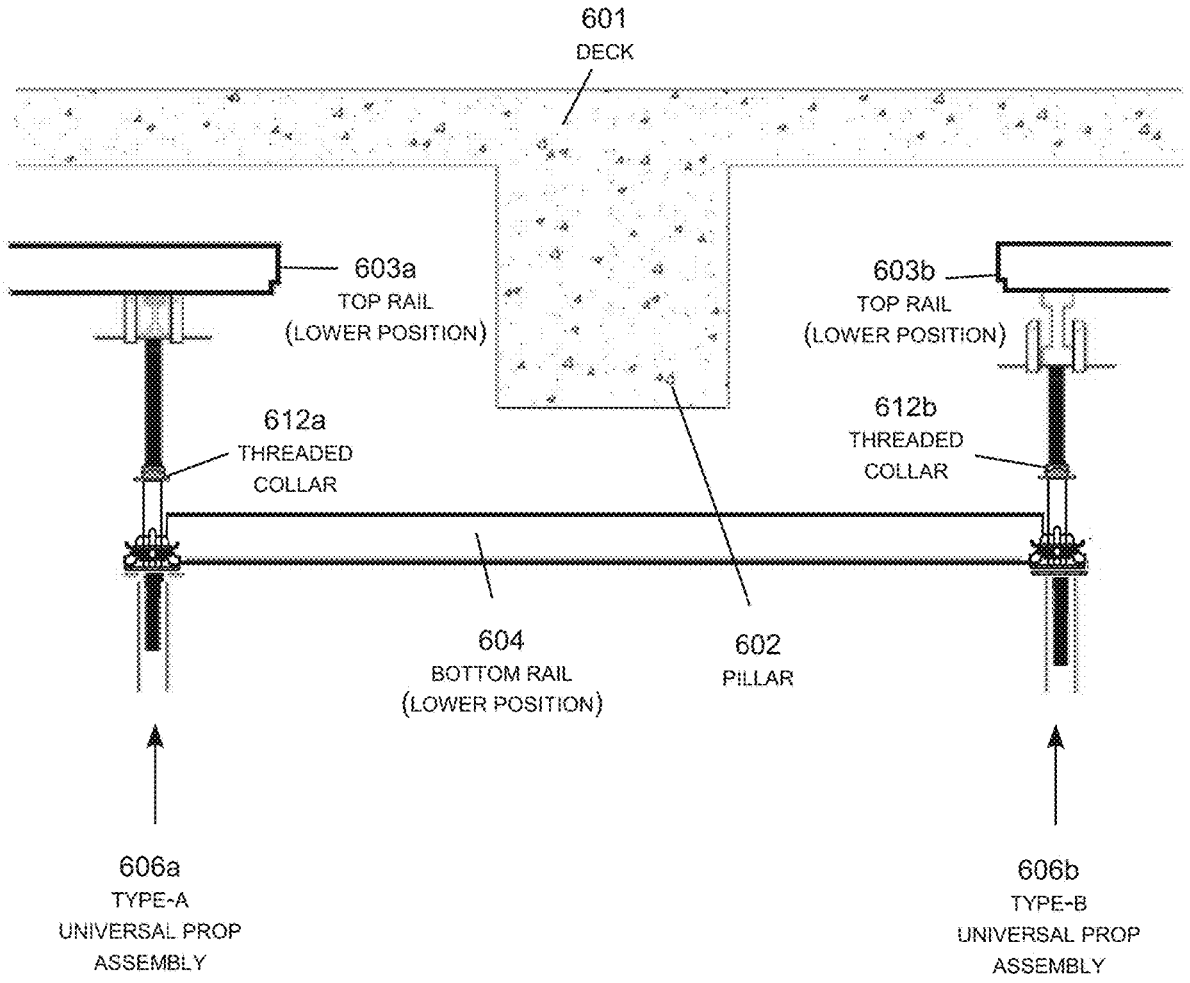
FIG. 6C is an elevational view of the bottom rail assembly with the top and bottom rails in lower positions.

FIG. 6A is an elevational view of a bottom rail assembly 600 forming a portion of a grid shoring system for fabricating a deck 601 and a pillar 602 with top rails 603*a* and 603*b* in their upper positions (upper top rail positions), as well as a bottom rail 604 in its upper position (upper bottom rail position). FIG. 6B shows the bottom rail assembly 600 beam assembly with the top rails 603*a* and 603*b* in their upper positions (upper top rail positions), and the bottom rail 604 in its lower position (lower bottom rail position). Continuing with the progression, FIG. 6C shows the bottom rail assembly 600 with the top rails 603*a* and 603*b* in their lower positions (lower top rail positions), along with the bottom rail 604 in its lower position (lower bottom rail position).

In FIG. 6A, The universal props 606*a* and 606*b* support the top rails 603*a*, 603*b* and the bottom rail 604. Specifically, the universal prop 606*a* supports the top rail 603*a* and one end of the bottom rail 604 an adjustable separation distance from the top rail 603*a*, while the universal prop 606*b* supports the top rail 603*b* and the other end of the bottom rail 604 an adjustable separation distance from the top rail 603*b*. The universal props 606*a* and 606*b* include threaded rods that telescopically extend through the unobstructed bores of the drop heads to allow the illustrated functionality. The universal props 606*a* and 606*b* also support concrete forms represented by the enumerated concrete forms 605*a*, 605*b* and 605*c* other structures supporting the deck 601 and pillar 602 while the concrete forming the deck and pillar is poured and allowed to set. It will be understood by those skilled in the grid shoring industry that the concrete forms generally include additional plywood, metal or plastic sheets, end plates and so forth, which are not instrumental for the presently claimed subject matter and, therefore, will not be described in greater detail. Slot collar 609*a*

To illustrate the versatility of the universal prop system, the universal prop 606*a* is referred to as a "Type-A" universal prop topped with a first type of stringer head referred to as a "Type-A" stringer 607*a* supporting a first type of stringer referred to as a "Type-A" stringer 608*a*. Similarly, the universal prop 606*b* is referred to as a "Type-B" universal prop topped with a second type of stringer head referred to as a "Type-B" stringer head 607*b* supporting a second type of stringer referred to as a "Type-B" stringer 608*b*. In general, "Type-A" stringer heads may be specifically designed to support "Type-A" stringers, "Type-B" stringer heads may be specifically designed to support "Type-B" stringers. In practice, the universal prop system allows the construction workers to select among the various types of rails and rail interfaces, as well as various types of stringers and stringer heads, on an as-needed, where-needed basis. This innovation provides a much greater degree of flexibility and cost effectiveness over conventional grid shoring systems, which are limited to using drop heads with fittings specifically designed to interconnect with corresponding fittings on prefabricated beams.

FIG. 6A illustrates the point in the construction process while the poured concrete forming the deck 601 and pillar 602 sets. At this stage of the construction process, the top rails 603*a* and 603*b* are in their upper positions (upper top rail positions), and the bottom rail 604 is in its upper position (upper bottom rail positions). As shown in FIG. 6B, once the concrete has set sufficiently, the universal props 606*a* and 606*b* include drop heads 610*a* and 610*b* used to drop the bottom rail 604 to their lower position (lower bottom rail position) to facilitate removal of the concrete forms supporting the pillar 602. Before or after dropping the bottom rail 604, FIG. 6C shows the universal prop 606*a* includes a threaded collar 612*a* used to drop the top rail 604*a* to its lower position (lower top rail position) to facilitate removal of the concrete forms supporting one portion of the deck 601 (the left portion in the figure), while the universal prop 606*b* includes a threaded collar 612*b* used to drop the top rail 604*b* to its lower position (lower top rail position) to facilitate removal of the concrete forms supporting another portion of the deck 601 (the right portion in the figure).

Figure 7:
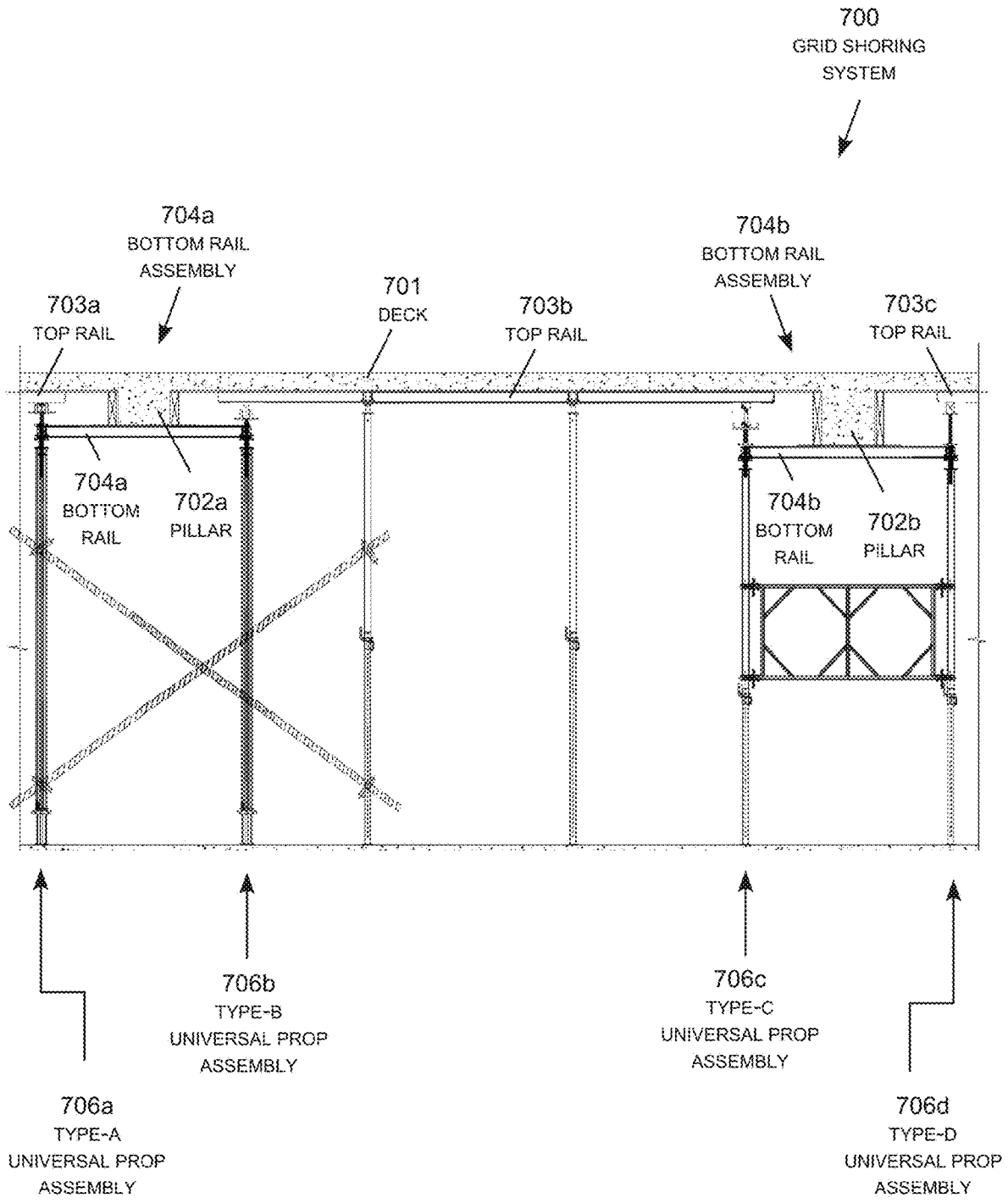
FIG. 7 is an elevational view of a grid shoring system including two bottom rail assemblies utilizing four of the universal prop assemblies with different stringer heads.

To further illustrate the versatility of the universal prop system, FIG. 7 is an elevational view of an expanded grid shoring system 700 supporting a deck 701 and two pillars 702*a* and 702*b* supported at different separation distances below the deck. The deck 701 is supported by top rails 703*a*, 703*b*, and 703*c*. The first pillar 702*a* is supported by a first bottom rail 704*a*, while the second pillar 702*b* is supported by a second bottom rail 704*b*. The top rail 703*a* and a first portion of the bottom rail 704*a* is supported by a first "Type-A" universal prop assembly 706*a*. The other end of the bottom rail 704*a* and a first end of the top rail 703*b* is supported by a second "Type-B" universal prop assembly 706*b*. The other end of the top rail 703*b* and a first end of the bottom rail 704*b* is supported by a third "Type-C" universal prop assembly 706*c*. And finally, the other end of the bottom rail 704*b* and a first end of the top rail 703*c* is supported by a fourth "Type-D" universal prop assembly 706*d*.

The "Type-A" universal prop assembly 706*a* is illustrated with a "Type-A" stringer head configured to support a "Type-A" stringer, the "Type-B" universal prop assembly 706*b* is illustrated with a "Type-B" stringer head configured to support a "Type-B" stringer, the "Type-C" universal prop assembly 706*c* is illustrated with a "Type-C" stringer head configured to support a "Type-C" stringer, and the "Type-D" universal prop assembly 706*d* is illustrated with a "Type-D" stringer head configured to support a "Type-D" stringer. These universal props assemblies operate as described previously with reference to FIGS. 6A-6C. Of course, these examples are merely illustrative, as more complicated grid shoring systems that can be constructed using the principles of the presently claimed subject matter presently claimed subject matter.

Figure 8:
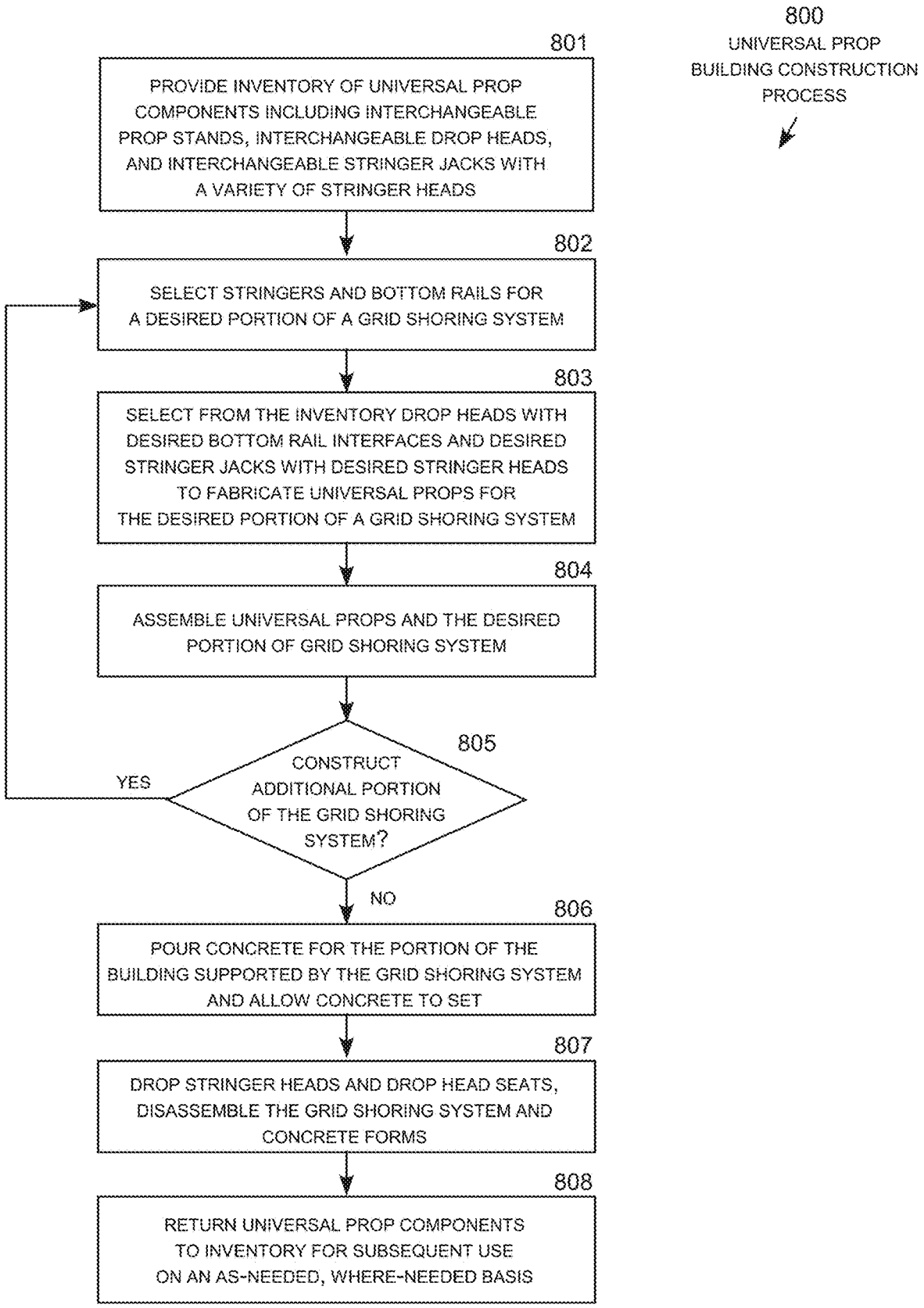
FIG. 8 is a logic flow diagram for a universal prop building construction process.

FIG. 8 is a logic flow diagram for a universal prop building construction process 800. In step 801, a building fabricator provides an inventory of universal prop components including interchangeable prop stands, interchangeable drop heads, and interchangeable stringer jacks with different types of stringer heads. The interchangeable prop stands may include a variety of different types of interchangeable prop stands, and the interchangeable drop heads may include a variety of different types of drop heads including different types of rail interfaces, such as standard beam fittings designed to interlock with standard beam fittings, standard rail fittings designed to interlock with other types of standard rail fittings, a variety of different types of rail interface clips, etc. The different types of stringer heads may include U-heads, spindle forks, jack plates, both detachable and attached to threaded rods, etc.

Step 801 is followed by step 802, in which the building fabricator selects stringer and bottom rail from the inventory for a desired portion of grid shoring system. Step 802 is followed by step 803, in which the building fabricator selects from the inventory drop heads with desired bottom rail interfaces and desired stringer jacks with desired stringer heads to fabricate universal props for the desired portion of a grid shoring system. Step 802 is followed by step 803, in which the building fabricator assembles the universal props and the desired portion of grid shoring system using the universal prop assemblies. Step 804 is followed by step 805, in which the building fabricator determines whether to construct an additional portion of the grid shoring system. If the building fabricator decides to construct an additional portion of the grid shoring system, the "yes" branch is followed from step 805 back to step 802 to begin assembly of the next portion of the grid shoring system.

If the building fabricator decides not to construct an additional portion of the grid shoring system, the "no" branch is followed from step 805 to step 806, in which the building fabricator pour the concrete for the portion of the building supported by the grid shoring system and allows the concrete to set. Once the concrete has set sufficiently, step 806 is followed by step 807, in which the building fabricator drops the stringer heads and drop head seats, and disassembles the grid shoring system and concrete forms. Step 807 is followed by step 807, in which the building fabricator returns the universal prop components to inventory for subsequent use on an as-needed, where-needed basis.

As used in this disclosure, the article "a" is intended to have its ordinary meaning in the patent arts, namely "one or more." Herein, the term "about" when applied to a value generally means within the tolerance range of the equipment used to produce the value, or in some examples, means plus or minus 10%, or plus or minus 5%, or plus or minus 1%, unless otherwise expressly specified. Further, herein the term "substantially" as used herein means a majority, or almost all, or all, or an amount with a range of about 51% to about 100%, for example. Moreover, examples herein are intended to be illustrative only and are presented for discussion purposes and not by way of limitation.

The words "couple," "adjacent" and similar terms do not necessarily denote direct and immediate connections, but also include connections through intermediate elements or devices. Certain descriptors, such "first" and "second," "top and bottom," "upper" and "lower," "inner" and "outer," "leading" and "trailing, "proximal" and "distal", "vertical" and "horizontal" or similar relative terms may be employed to differentiate structures from each other in representative embodiments shown in the figures. These descriptors are utilized as a matter of descriptive convenience and are not employed to implicitly limit the presently claimed subject matter to any particular position or orientation.

The foregoing description, for purposes of explanation, used specific nomenclature to provide a thorough understanding of the disclosure. However, it will be apparent to one skilled in the art that the specific details are not required to practice the systems and methods described herein. The foregoing descriptions of specific examples are presented for purposes of illustration and description. They are not intended to be exhaustive of or to limit this disclosure to the precise forms described. Those skilled in the art will appreciate that many modifications and variations are possible in view of the above disclosure. The examples are shown and described in order to best explain the principles of this disclosure and practical applications, to thereby enable others skilled in the art to best utilize this disclosure and various examples with various modifications as are suited to the particular use contemplated. It is intended that the scope of this disclosure be defined by the claims and their equivalents below.

The invention claimed is:

1. A universal prop system for a grid shoring system for building construction, comprising:

a plurality of interchangeable prop stands;

a plurality of interchangeable stringer jacks;

a plurality of interchangeable drop heads, each drop head for removably interconnecting a selected one of the interchangeable prop stands with a selected one of the interchangeable stringer jacks, each drop head further comprising a drop seat defining a bottom rail interface to removably support a bottom rail of the grid shoring system, wherein the bottom rail in an upper bottom rail position supports a lower concrete form supporting lower wet concrete while the lower wet concrete sets, and wherein the bottom rail in a lower position facilitates removal of the lower concrete form after the lower wet concrete sets;

wherein each drop seat is selectively movable between an upper drop seat position and a lower drop seat position to move the bottom rail between an upper bottom rail position and a lower bottom rail position; and the variety of stringer jacks each comprise a threaded rod, a threaded collar movably captured on the threaded rod, and a stringer head connected to the threaded rod to support a top rail of the grid shoring system;

wherein each stringer jack telescopically interconnects with a selected drop head to selectively move the stringer head with respect to the selected drop head between an upper stringer head position and a lower stringer head position in response to rotation of the threaded collar to move the top rail between an upper top rail position and a lower top rail position, wherein the top rail in the upper top rail position supports an upper concrete form supporting upper wet concrete while the upper wet concrete sets, and wherein the top rail in the lower top rail position facilitates removal of the upper concrete form after the upper wet concrete sets.

2. The universal prop system of claim 1, wherein the upper wet concrete forms a deck and the lower wet concrete forms a pillar.

3. The universal prop system of claim 1, wherein the plurality of interchangeable drop heads each comprise universal clip interfaces for selectively connecting to a plurality of different drop head clips configured to support different types of bottom rails.

4. The universal prop system of claim 1, wherein each interchangeable stringer jack comprises a threaded rod configured to be partially received within an unobstructed bore of a selected drop head with its threaded collar bearing against a top end of the drop head.

5. The universal prop system of claim 1, wherein the plurality of interchangeable stringer jacks each comprise a stringer head permanently attached to the threaded rod of the stringer jack.

6. The universal prop system of claim 1, wherein the plurality of interchangeable stringer jacks each comprise a stringer head that is detachable from the threaded rod of the stringer jack.

* * * * *